United States Patent [19]

Weber

[11] 4,383,722

[45] May 17, 1983

[54] SHOW CASE, IN PARTICULAR FOR DISPLAYING SHOES OR THE LIKE

[76] Inventor: Leo Weber, Bahnhofstrasse 7, A-9360 Friesach, Austria

[21] Appl. No.: 210,198

[22] Filed: Nov. 25, 1980

[30] Foreign Application Priority Data

| | | | |
|---|---|---|---|
| Nov. 27, 1979 | [AT] | Austria | 7514/79 |
| Jul. 14, 1980 | [AT] | Austria | 3646/80 |
| Oct. 3, 1980 | [AT] | Austria | 4929/80 |

[51] Int. Cl.[3] ..... A47F 7/08; A47B 88/00

[52] U.S. Cl. ..... 312/324; 312/120; 312/133; 312/323; 211/37

[58] Field of Search ..... 312/327, 322, 323, 324, 312/120, 132, 133; 211/36, 37; 108/5

[56] References Cited

U.S. PATENT DOCUMENTS

| | | | |
|---|---|---|---|
| 154,244 | 8/1874 | Hacker | 312/327 |
| 689,588 | 12/1901 | Hoult | 312/323 |
| 726,748 | 4/1903 | Polson | 211/37 |
| 1,189,371 | 7/1916 | Lyons | 312/322 |
| 1,589,198 | 6/1926 | McComb | 211/36 |
| 1,944,649 | 1/1934 | Smith, Sr. | 211/37 |
| 2,196,044 | 4/1940 | Tyrrell | 108/62 |
| 2,431,423 | 11/1947 | Robbins | 211/37 |
| 2,467,042 | 4/1949 | Konikoff | 211/37 |
| 2,586,665 | 2/1952 | Konikoff | 211/37 |
| 3,250,234 | 5/1966 | Holt | 108/5 |
| 3,822,924 | 7/1974 | Lust | 312/108 |

FOREIGN PATENT DOCUMENTS

| | | | |
|---|---|---|---|
| 130178 | 11/1948 | Austria | 312/323 |
| 2529198 | 1/1977 | Fed. Rep. of Germany . | |
| 226428 | 4/1943 | Switzerland | 211/37 |

*Primary Examiner*—Victor N. Sakran

*Attorney, Agent, or Firm*—Pollock, VandeSande & Priddy

[57] ABSTRACT

A show case, e.g. for displaying shoes or the like, comprises horizontal shelf plates (2) and tilted shelf plates (3). The tilted shelf plates (3) are pivotably supported and can be tilted upwardly. The pivots (7, 22) and the support elements (8, 14, 29) of the tilted shelf plates (3) as well as the support elements (6, 14) of the horizontal shelf plates (2) are vertically displaceable in side plates (1) of the show case and may be locked in desired positions.

3 Claims, 14 Drawing Figures

SHOW CASE, IN PARTICULAR FOR DISPLAYING SHOES OR THE LIKE

BACKGROUND OF THE INVENTION

1. Field of the Invention

The invention refers to a show case, in particular for displaying shoes or the like, comprising horizontal shelf plates as well as shelf plates tilted from the rear toward the front, said tilted shelf plates being disposed each above a horizontal shelf plate and supported by a horizontal pivot axis located in a rear area of the show case and being upwardly tiltable around said pivot axis.

2. Description of the Prior Art

Show cases with horizontal and tilted shelf plates as used in the past in the field of store architecture have impressive number of drawbacks. The confusing mass of shoes presented in pairs renders the customer his decision to purchase difficult, and, particularly if the sales facilities are difficult to survey, or in supermarkets, the danger of theft is increased. The solution as adopted in some instances, to display only one shoe of the pair, is not suited as a permanent solution because the sales personnel must spend a lot of time for procuring the second shoe of the pair from storage.

The suggestion had already been made, to build a show case of the kind mentioned above. Such a show case makes it possible to place one shoe of a pair on the tilted shelf plate, and the other on the horizontal shelf plate underneath. A show case of this kind is disclosed in DE-OS No. 25 29 198. A disadvantage of this known show case consists in the fact, that the pivotably tilted shelf plate is supported on the horizontal shelf plate located below, in the region of its front edge. This makes it impossible, to select the slope of the tilted shelf plate independent of its distance from the horizontal shelf plate. On the contrary, the show case disclosed in DE-OS No. 25 29 198 has the disadvantage, that the distances between the horizontal and the tilted shelf plates corresponding to a specific slope is set once and for all, so that this distance must be selected considering the largest sized pair of shoes.

It is an object of the present invention, to make improvements on the show case mentioned above, so as to avoid the previously mentioned drawbacks and, particularly, to make it adaptable in a simple manner to the conditions concerning availability of space, for example in a sales store. Another object is to build a show case pleasing to the eye.

SUMMARY OF THE INVENTION

The foregoing and other objects are attained according to one aspect of the invention by making the pivots of the tilted shelf plates as well as the support elements disposed in the frontal area of the show case and which determine the slope of the tilted shelf plates upwardly displaceable within side plates provided on the two sides of the shelf plates, and support elements supporting the horizontal shelf plates also upwardly displaceable within said side plates.

In order to prevent the shoes from sliding off the tilted shelf plates there may be provided retaining bars or ledges which may be locked in different positions on the tilted shelf plates. In such an embodiment the shoes supported on the tilted shelf plates abut with the front side of their heel against the retaining bar or ledge.

In one practical embodiment of the show case bearing boxes receiving the pivots fastened onto the side plates are connected in particular with the tilted shelf plates at the rearward areas thereof, said bearing boxes being disposed in lateral glued parts which may be provided, e.g. of wood or plastic, running perpendicular to the plane of the tilted shelf plate. This embodiment shows not only a particularly stable construction of the shelf plates, which, when wood is used, is also pleasing to the eye, but the application of the pivot bearing is also much simplified.

According to one embodiment of the invention each bearing box is provided with an angled slot open toward the side plate and having one leg running perpendicular, and another leg running parallel to the tilted shelf plate, said perpendicular leg being open at its bottom and said parallel leg being closed toward the rear. These features make it exceedingly simple to insert the tilted shelf plates into the show case.

Within the framework of the invention elastic cams may be provided in the leg running parallel to the tilted shelf plate for securely holding the pivot pin.

Especially if the glued pieces are made of wood, it may be of advantage to build said bearing box provided with said angled slot as one component, e.g. of plastic, insertable into said lateral glued piece.

Furthermore, provision may be made within the framework of the invention, to provide the horizontal shelf plates on their lateral surfaces facing the side plates with slots engaged by the pivots fastened onto the side plates, e.g. locked within their longitudinal slots. This embodiment allows for a particularly secure and visually pleasing application of the horizontal shelf plates.

It may not be desirable to provide for an unconditional possibility of tilting the tilted shelf plates upward for the purpose of making accessible the shoes resting on the horizontal shelf plates. If such be the case, there may be provided within the framework of the invention, lock bars disposed below the tilted shelf plates, each lock bar being retractable against the force of a spring from its locking position, in which said lock bar engages a support plate from underneath.

BRIEF DESCRIPTION OF THE DRAWINGS

Additional details and advantages follow from the subsequent description of the embodiments schematically shown in the drawings. The figures show.

DETAILED DESCRIPTION OF THE PREFERRED EMBODIMENTS

Figure 1:
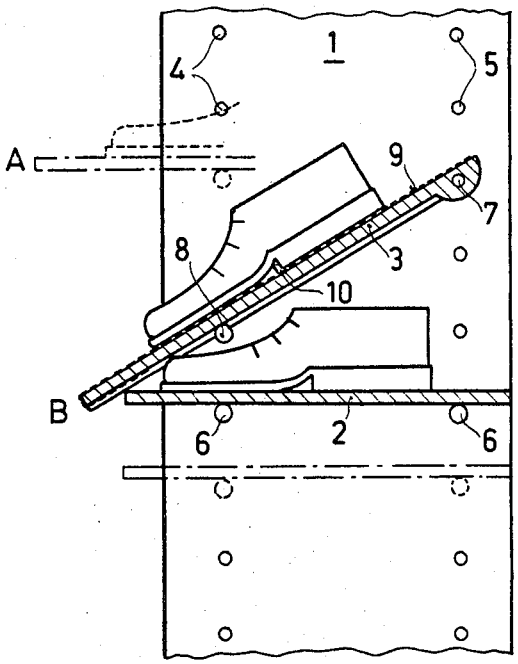
FIG. 1 a vertical section through one portion of the show case.
Figure 11:
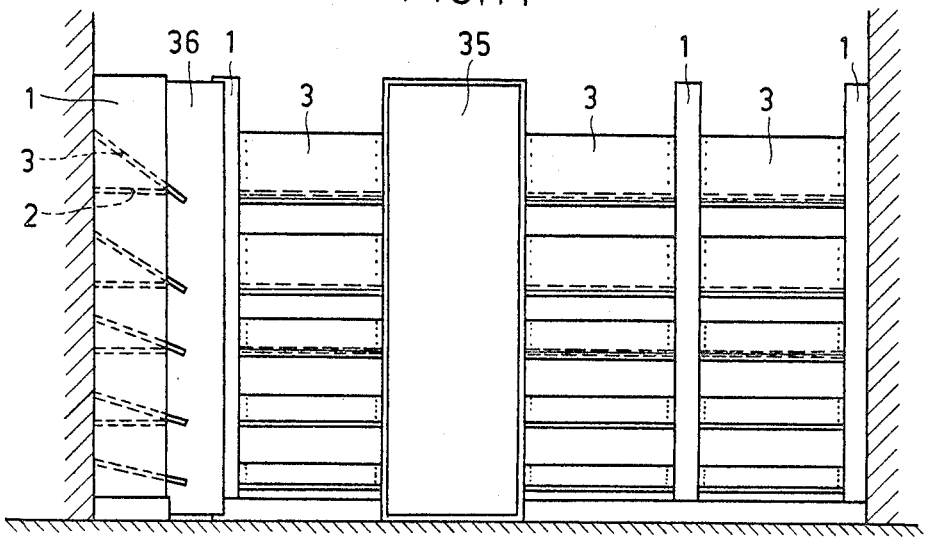
Figure 12:
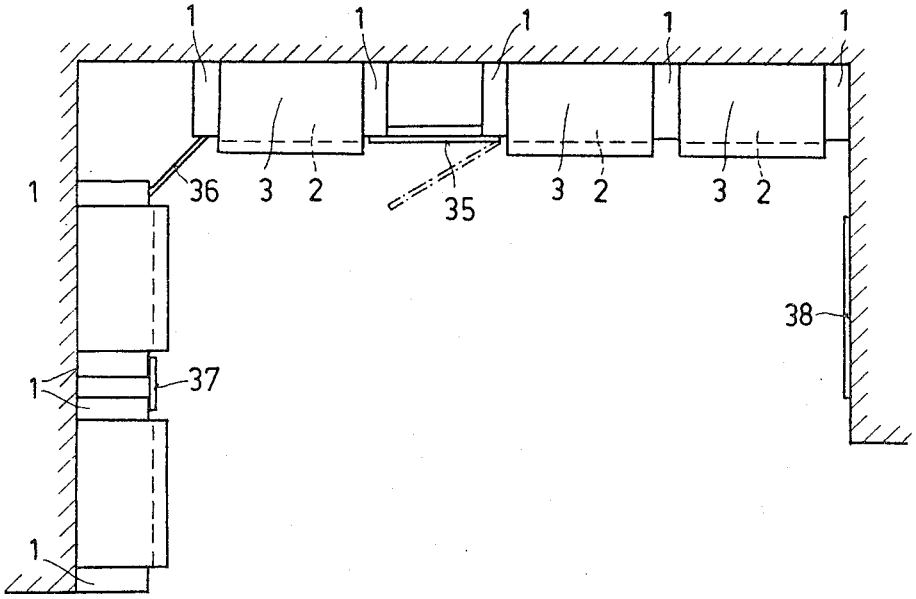

In accordance with FIGS. 1, 11 and 12 in particular, the show case of the invention comprises horizontal shelf plates 2 and tilted shelf plates 3 disposed between vertical side plates 1. In the embodiment of FIG. 1 there are provided in the side plates 1 two rows of holes 4 and 5 equidistantly positioned to one another. The support elements 6 for the horizontal shelf plates 2 are realized as pins and inserted in the places where needed, i.e. in the places where a horizontal shelf plate is to be positioned.

As shown in FIG. 1 the tilted shelf plates 3 can be turned each in the region of its rear end around a pivot inserted in one of the holes 5. The lower end position B is set by means of a support element 8 inserted in one of the holes 4 of the front row. It is easily seen, that the lower end position B of the tilted shelf plate 3 may be selected at will, depending on the particular hole 4, into which the support element 8 has been inserted.

However, the support element 8 may be inserted into a hole 4 high enough, to place the tilted shelf plate 3 into the horizontal position A as shown in FIG. 1 by dash-dotted lines.

Inasmuch as the slope of the tilted shelf plates 3 may be selected without regard to their distances from the shelf plates 2 located underneath, it is possible to arrange the support elements 8 in such a way, that the tilted shelf plates 3 occupy in their lowest position the position B and to gradually reduce their slope until they occupy the position A in their highest position.

The tilted shelf plates 3 may be provided with a non-skid surface 9 and/or with a retaining bar or ledge 10.

Holes located at varying distances from the front edge of the shelf plate 3 may be provided for inserting the retaining ledge 10 into the shelf plate 3. It is also possible to adjust the position of the retaining ledge to the particular conditions prevailing in regard to the display of shoes with wedge soles (front position of ledge) of children's, ladies', or gentlemen's shoes. If a second ledge is positioned at the rear end of the shelf plate, it may be possible to place two rows of children's shoes on the shelf plate 3.

If for preventing the skidding of shoes off the tilted shelf plates 3 a retaining ledge is provided thereon, said retaining ledge may be insertable for instance into lateral glued pieces disposed on both sides of the shelf plates 3 and connected therewith, and be formed if desirable, in a shape corresponding to the front edge of the shelf plate 3. Thus, e.g. if the front edge of the shelf plate 3 has a concave curvature, the retaining ledge may be formed with a similar curvature.

The show case of the invention provides for the second shoe of a pair mating with the shoe resting on a tilted shelf plate 3 to be positioned on the invisible horizontal shelf plate 2 located below the shelf plate 3. This represents an important advantage of the invention, because the distance between each tilted shelf plate 3 and its corresponding shelf plate 2 may be adjusted in accordance with the height of the particular model of shoe to be displayed. If, at any time, the second shoe resting on the horizontal shelf plate 2 is wanted, the tilted shelf plate 3 is turned upward, rendering thereby the second shoe of the pair accessible.

Figure 2:
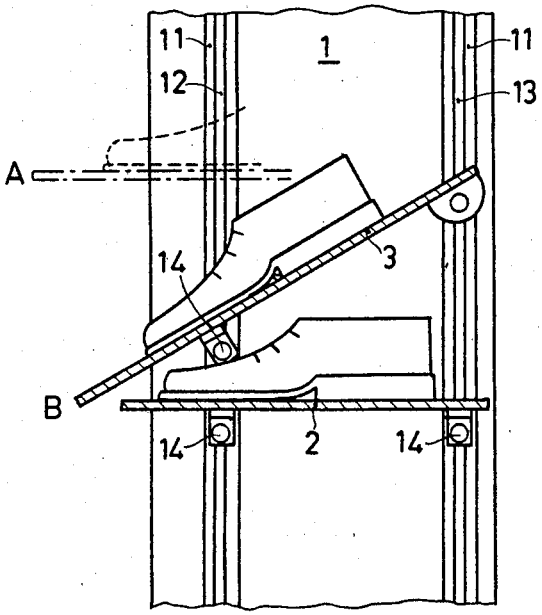
FIG. 2 a view analogous to the view of FIG. 1 of another embodiment of the show case, FIG. 3 a section along the line III—III in FIG. 2, FIG. 4 a section along the line IV—IV in FIG. 2, FIG. 5 an embodiment of the support elements for the horizontal shelf plates, FIG. 6 a section along the line VI—VI in FIG. 5, FIG. 7 an embodiment of the pivot bearing of the tilted shelf plates, FIG. 8 a section along the line VIII—VIII in FIG. 7, FIGS. 9 and 10 an arrangement for locking the tilted shelf plates, FIG. 11 an example of an arrangement of show bases in a sales store, FIG. 12 a top view of the arrangement of FIG. 11, FIG. 13 an arrangement of boot supports in a show case, and FIG. 14 a different embodiment of boot supports.

The embodiment of FIG. 2 shows side plates 1 with slots 12 and 13 therein running vertically and formed in profile rails 11, in which slots the pivots and the support elements for the tilted shelf plates 3, as well as the support elements for the horizontal shelf plates 2 can be locked in position at any height. This embodiment offers the possibility of an infinitely variable adjustment of the desired height of the shelf plates 2 and 3, and of the slope of the tilted shelf plate 3.

The horizontal shelf plates 2 may be pushed forward from their position shown in FIG. 1 whenever the tilted shelf plates 3 are kept in their turned-up position, as e.g. in the event of a clearance sale. As soon as one show case is partially emptied, one or several of the tilted shelf plates 3 may be lowered again, so as to always impart the visual impression of full show cases.

Figure 3:
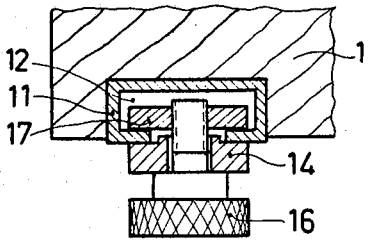
Figure 4:
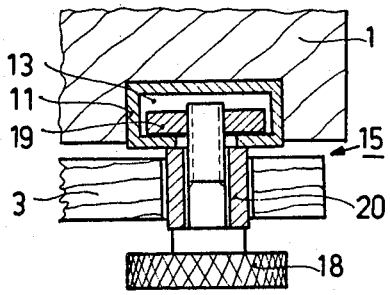

According to FIG. 3, the clamping washer 14 is penetrated by the shaft of a knurled head screw 16 screwed into a clamping nut 17 displaceably held in the slot 12 or 13 within the profile rail 11. The support element 14 may be fastened at any height by tightening the knurled head screw 16.

In the embodiment of FIG. 2 the front support elements of the tilted shelf plate 3 are built identical with the support elements 14 of the horizontal shelf plates 2. The pivot bearing located at the rear end of the tilted shelf plate 3 also comprises a knurled head screw 18 screwed into a clamping nut 19 displaceably held in the slot 13. A sleeve 20 disposed between the head of the knurled head screw 18 and the profile rail 11 fulfills the function of a pivot pin for the tilted shelf plate 3. It is clear, that the pivoting device 15 may be displaced along the profile rail 11 in the background by loosening the knurled head screw 18 and may be locked at any desired height by tightening the knurled head screw 18.

Figure 5:
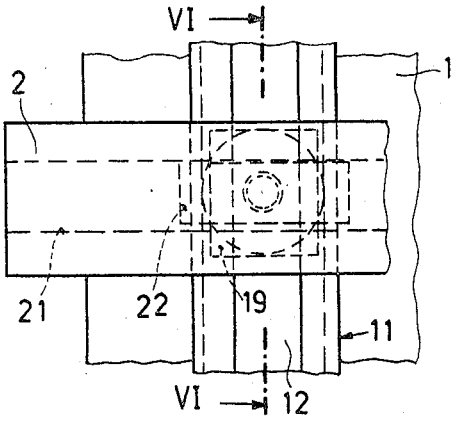
Figure 6:
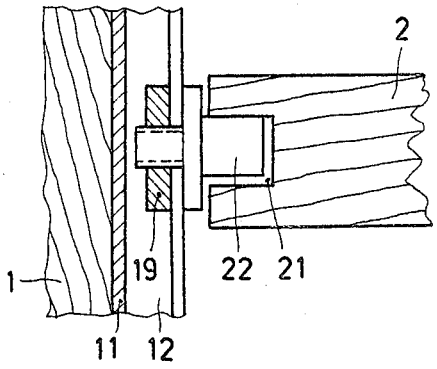

FIGS. 5 and 6 show another method of fastening the horizontal shelf plates 2 on the side plates 1. In this embodiment, slots 21 are provided in the lateral faces of the horizontal shelf plates 2, which slots 21 are engaged by the heads of the fastening screws 22 built as sliding elements. The fastening screws 22 are screwed into the clamping nuts 19 held within the slots 12.

Figure 7:
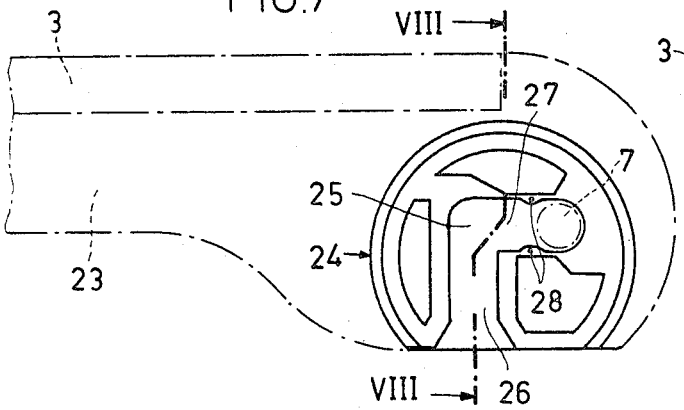
Figure 8:
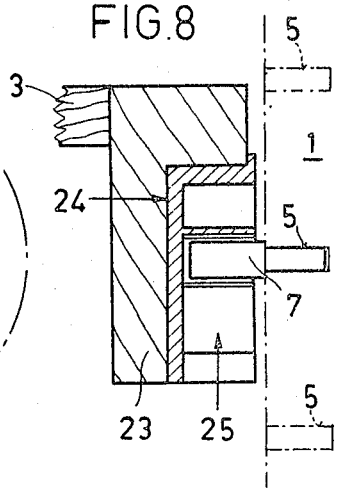

The pivot bearings may be built as shown in the FIGS. 7 and 8, in particular if the tilted shelf plates 3 comprise lateral glued parts 23, which e.g. may be made of wood. In the embodiment shown a pivot bearing includes a bearing box 24 pressed into a corresponding milled-out recess of a lateral glued part 23. If the lateral glued part 23 consists of a material different from wood, e.g. of plastic, then the bearing box may be made in one piece with the lateral glued part 23.

The bearing box 24 comprises an angled slot 25 having one leg 27 running parallel and one leg 26 running perpendicular to the tilted shelf plate 3. The perpendicular leg 26 is open at its bottom and broadens in its end region. The horizontal leg 27 comprises cam surfaces 28 which protrude inwardly and are elastically displaceable outwardly, if a pivot 7 is pushed by way of the slot 25 into its final position shown in FIG. 7. The pivot 7 may be a simple pin, as shown in FIG. 8, inserted in one of the holes 5 of a side plate 1, or it may be carried out similar to a support element for the horizontal shelf plate 2, as shown in FIGS. 5 and 6.

Figure 9:
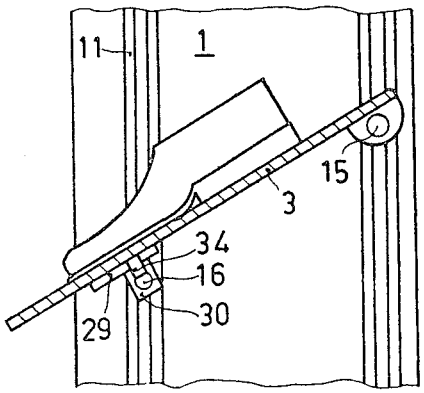
Figure 10:
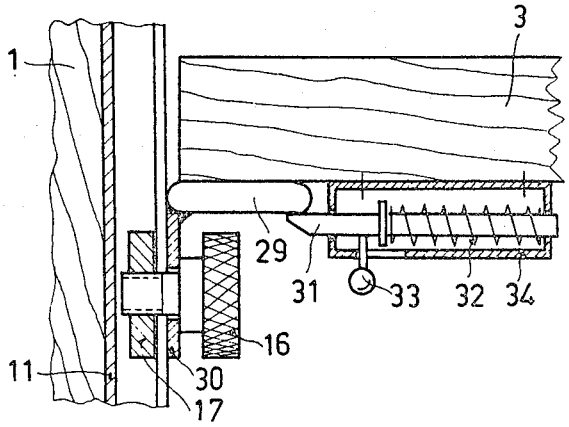

If it be desirable not to provide for an unconditional tilting upward of the shelf plates 3, a locking device as shown in FIGS. 9 and 10 may be provided for each tilted shelf plate 3 in the region of its front edge, which device in its locked position prevents the shelf plate 3 from being tilted upward.

If a locking device according to FIGS. 9 and 10 is provided, the front support element of the tilted shelf plate 3 is modified to some extent, in order to provide for the locking device a better possibility of engagement. As shown in FIG. 10, a support plate 29 is provided protruding beyond the knurled head screw 16 and comprising an extension piece 30, which may be clamped by the knurled head screw 16 against the profile rail 11. The support plate 29 is engaged by a lock bar 31 disposed within a spring 32 inside a housing 34 and displaceable toward the side plate 1. If the shelf plate 3 now locked against any upward motion is to be made free to be tilted upward, the lock bar 31 must be retracted from its locking position shown in FIG. 10 against the force of the spring 32 using the hand lever 33. This step, which for the sales personnel is only a minor task, represents an effective protection against theft, due to the invisibility of the locking device covered up by the tilted shelf plate 3. If the shelf plate 3 is swung down again, the lock bar 31 automatically engages the lower surface of the support plate 29, so that the locking device is effective again.

FIGS. 11 and 12 show an embodiment which proves the adaptability of the show case of the invention. It may be seen, that the free space between the individual show cases may be bridged by swinging doors 35, e.g. with mirrors on the outside, or with mirrors 37 fixedly mounted in place. The mirrors 36 and 38 additionally shown in FIG. 12 serve for optical room enlargement and as control mirror, respectively.

The show cases may be positioned along room walls, as shown in FIGS. 11 and 12, or several show cases may be arranged in an open room in the form of a show case tower having in horizontal projection the shape of part of a polygon.

Figure 13:
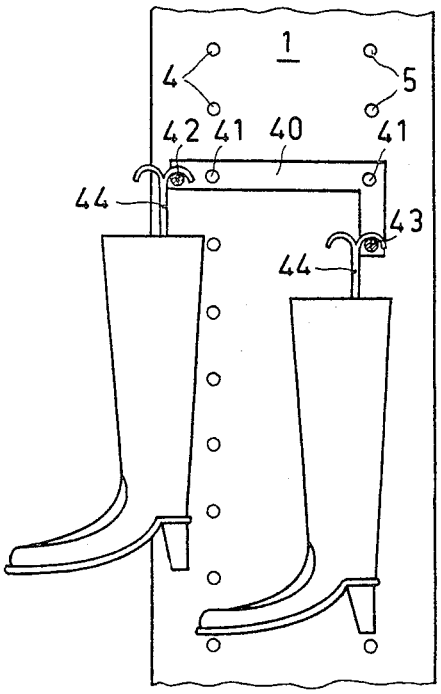
Figure 14:
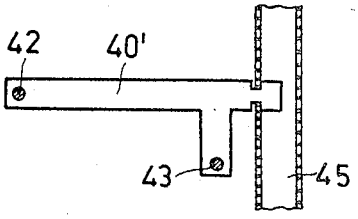

The show case may also be used for displaying pairs of boots, as shown in FIGS. 13 and 14. For this purpose, angular parts 40 are fastened onto the side plates 1 by means of pins inserted into appropriately selected holes 4 and 5. Between these supporting beams fastened onto the inner surfaces of the side plates 1 extend the bars 42 and 43, on which are suspended the boots by means of the hooks 44 inserted into the boots. FIG. 13 clearly shows that the bar 42 is located higher than the bar 43, so that a space saving arrangement may be achieved. Even then using the show case for displaying boots, the arrangement is such, that only one boot of a pair is visible, the second being, however, well accessible.

FIG. 14 shows a boot carrying angle 40′, which also supports cross bars 42 and 43, but which, in contradistinction to the embodiment of FIG. 13 is fastened not onto the side plate 1 but rather in a hole of a profile rail 45.

In place of the pins 6 shown in FIG. 1, the horizontal shelf plates 2 may be supported by support members in the form of brackets with bent-down parts insertable into the appropriate holes 4 and 5 of the side plates 1. In a particularly advantageous arrangement the horizontal shelf plates 2 are provided in their lateral faces, in a manner analogous to FIGS. 5 and 6, with slots 21 in which the brackets may be inserted. The shelf plates 2 may then be displaced both forward and rearward.

If the tilted shelf plates 3 do not have any lateral glued parts, the bearing box 24 shown in FIGS. 7 and 8 may be fastened directly onto the side edges of the tilted shelf plates 3. For example, it may be pressed into appropriately shaped recesses of the shelf plates 3.

In a simplified embodiment of the invention, instead of using the locking device shown in FIGS. 9 and 10 for locking the tilted shelf plates 3 against being tilted upward, this function may be achieved by providing above the frontal region of the shelf plates 3 bolts inserted into corresponding holes 4, the bolts being appropriately given a color corresponding to that of the side plates and/or the shelf plates 3, or their lateral glued parts.

FIG. 11 also shows the holes provided in the tilted shelf plates 3 or in the lateral glued parts connected therewith, into which holes the bent ends of the retaining brackets may be inserted.

An embodiment displaying the features shown in FIGS. 2, 3, 4, 9 and 10 may be considered as the best mode of carrying out the invention.

What is claimed is:

1. Show case, in particular for displaying shoes or the like, in which horizontal shelf plates (2) as well as shelf plates (3) tilted from the rear toward the front are provided, said tilted shelf plates (3) being disposed each above a horizontal shelf plate (2) and supported by a horizontal pivot axis located in a rear area of the show case and being upwardly tiltable around said pivot axis, wherein the pivots (7, 22) of the tilted shelf plates (3) as well as the support elements (8, 14, 29) disposed in the frontal area of the show case and which determine the slope of the tilted shelf plates (3) are upwardly displaceable within side plates (1) provided on the two sides of the shelf plates (2 and 3), and support elements (6, 14) supporting the horizontal shelf plates (2) also are upwardly displaceable within said side plates (1), and wherein provisions are made to lock the pivots (22) and the support elements (14) for the tilted shelf plates (3) and the support elements (14, 22) for the horizontal shelf plates (2) in position within recessed slots (12, 13) running vertically within said side plates (1) and formed e.g. in profiles (11), and further wherein bearing boxes (24) receiving the pivots (7, 22) fastened onto the side plates (1) are connected in particular with the tilted shelf plates (3) at the rearward regions thereof, said bearing boxes (24) being disposed in lateral glued parts (23) which may be provided, e.g. of wood or plastic, running perpendicular to the plane of the tilted shelf plate (3), and further wherein each bearing box (24) is provided with an angled slot (25) open toward the side plate (1) and having one leg (26) running perpendicular, and another leg (27) running parallel to the tilted shelf plate (3), said perpendicular leg (26) being open at its bottom and said parallel leg (27) being closed toward the rear.

2. Show case as claimed in claim 1, wherein elastic cams (28) are provided in the leg (27) running parallel to the tilted shelf plate (3) for securely holding the pivot pin (7, 22) in the bearing box (24).

3. Show case as claimed in claim 1, wherein said bearing box (24) provided with said angled slot (25) is constructed as a component, e.g. of plastic, insertable into said lateral glued piece (23).

* * * * *